US008638277B2

(12) United States Patent
Miwa

(10) Patent No.: US 8,638,277 B2
(45) Date of Patent: Jan. 28, 2014

(54) DISPLAY DEVICE

(75) Inventor: Koichi Miwa, Tokyo (JP)

(73) Assignee: Global OLED Technology LLC, Herndon, VA (US)

( * ) Notice: Subject to any disclaimer, the term of this patent is extended or adjusted under 35 U.S.C. 154(b) by 301 days.

(21) Appl. No.: 13/020,488

(22) Filed: Feb. 3, 2011

(65) Prior Publication Data

US 2011/0187761 A1 Aug. 4, 2011

(30) Foreign Application Priority Data

Feb. 4, 2010 (JP) ..... 2010-23285

(51) Int. Cl.
*G09G 3/30* (2006.01)

(52) U.S. Cl.
USPC ..... 345/76; 345/82; 345/690

(58) Field of Classification Search
USPC ..... 345/76, 82, 204, 690; 315/169.1–169.4; 313/500
See application file for complete search history.

(56) References Cited

U.S. PATENT DOCUMENTS

| | | | | |
|---|---|---|---|---|
| 7,245,277 | B2 * | 7/2007 | Ishizuka | 345/78 |
| 7,355,574 | B1 | 4/2008 | Leon et al. | 345/82 |
| 7,872,619 | B2 * | 1/2011 | Miller et al. | 345/77 |
| 8,358,256 | B2 * | 1/2013 | Hamer et al. | 345/77 |
| 2005/0179626 | A1 | 8/2005 | Yuki et al. | 345/76 |
| 2006/0253755 | A1 | 11/2006 | Wu | 714/726 |
| 2007/0155140 | A1 | 7/2007 | Hatano et al. | |
| 2008/0198182 | A1 | 8/2008 | Uchino et al. | |

FOREIGN PATENT DOCUMENTS

| | | |
|---|---|---|
| EP | 1 135 764 A1 | 9/2001 |
| JP | 2005-217214 | 8/2005 |
| JP | 2008-203387 | 9/2008 |
| WO | WO 01/26087 A1 | 4/2001 |

OTHER PUBLICATIONS

Kondakova, M. et al., "P-148: Temperature Dependence of Degradation in Organic Light-Emitting Diodes", SID 09 Digest, 1677-1680, 2009.

* cited by examiner

*Primary Examiner* — Abbas Abdulselam
(74) *Attorney, Agent, or Firm* — Global OLED Technology LLC

(57) ABSTRACT

To compensate for a change of light emission intensity caused by deterioration of a light emitting element, provided is a display device including a drive element (T1) which controls a drive current to be supplied to a light emitting element (EL) in accordance with a data signal representing a target luminance of the light emitting element (EL). The light emitting element (EL) emits light in accordance with a current flowing through the light emitting element (EL). The data signal is corrected in accordance with a voltage applied at both terminals of the light emitting element (EL) so that the drive current to be supplied to the light emitting element (EL) increases with an increase in an amount of a voltage drop of the light emitting element (EL).

8 Claims, 9 Drawing Sheets

β: TRANSCONDUCTANCE OF T3
a, b: CONSTANT DETERMINED BY DESIGN PARAMETER

EXAMPLE OF PIXEL CURRENT SIMULATION OF CIRCUIT OF SECOND EMBODIMENT

EXAMPLE OF PIXEL LUMINANCE CALCULATION OF PIXEL CIRCUIT OF SECOND EMBODIMENT (EL vs ΔV: C545T @22C [Ref.3])

EXAMPLE OF PIXEL LUMINANCE CALCULATION OF PIXEL CIRCUIT OF SECOND EMBODIMENT (EL vs ΔV: DC/TB @65C [Ref.3])

DISPLAY DEVICE

CROSS-REFERENCE TO RELATED APPLICATION

The present application claims priority to and benefit of Japanese patent Application Serial No. 2010-23285, filed in Japan Patent Office on Feb. 4, 2010, the entire contents of which are incorporated herein by reference.

BACKGROUND OF THE INVENTION

1. Field of the Invention

The present invention relates to a display device including a self light emitting element, and a method of driving the display device.

2. Description of the Related Art

In recent years, organic EL displays have been actively developed, and have achieved a significant advancement. In a display device including a self light emitting element such as an organic EL element, light emission may be controlled pixel by pixel, and hence there are advantages in contrast and viewing angle characteristics. When used in video display or the like, there is also a merit that reduction in power consumption may be achieved because an average display gradation is low. Meanwhile, when the characteristics of the light emitting element themselves are deteriorated by its use, luminance reduction occurs in accordance with a usage history of each pixel. The luminance reduction occurs at a predetermined pattern depending on displayed images or the usage, and in some cases, the luminance reduction may be visually recognized as "screen burn-in."

In a case where an organic EL element is used as the light emitting element, light emission intensity is proportional to a current flowing through the element. The ratio between the light emission intensity and the current flowing through the element is called a current luminous efficiency. Normally, the current luminous efficiency is determined based on an organic material forming the light emitting element, an element structure, an interface state, or the like, and the current luminous efficiency is uniform across the entire display region. Therefore, when uniform display characteristics are desired to be obtained, it is only necessary to control, pixel by pixel, the current to be supplied to the light emitting element, so as to obtain uniform display. In an active matrix type organic EL display, the current is controlled by a thin film transistor (TFT) element provided in each pixel, and thus the organic EL element is driven. Generally, a low-temperature polycrystalline silicon TFT or the like is used as the TFT element.

As characteristics of the low-temperature polycrystalline silicon TFT, there is a problem in that, because of grain boundary scattering of conduction electrons, fluctuation in mobility or in turn-on voltage occurs among the pixels. Therefore, efforts have been made to obtain uniform display characteristics by suppressing the fluctuation in mobility or in turn-on voltage and by correcting the fluctuation, to thereby enable uniform pixel current supply. For example, Japanese Patent Application Laid-open No. 2005-217214 describes a technology in which the crystal-growth direction of the polysilicon is controlled to obtain crystalline grains of uniform shapes. Further, there have been proposed many technologies for suppressing fluctuation in display characteristics caused by fluctuation in threshold voltage of the TFT, by adding, to a pixel circuit, a function to offset a threshold voltage of a drive TFT. For example, Japanese Patent Application Laid-open No. 2008-203387 is proposed.

Here, the conventional technologies described above are based on the presupposition that the organic EL element maintains the in-plane uniformity of the current luminous efficiency. However, in actual use, the organic EL element itself is deteriorated by its use, and the current luminous efficiency is accordingly reduced. Reflecting the difference of the usage history among the pixels, the current luminous efficiency is reduced in different speed among the pixels. Depending on the usage of the display device and the displayed images, the difference of the deterioration speed among the organic EL elements may be increased to an extent not negligible. In this case, the difference is visually recognized as display luminance unevenness and screen burn-in. Generally, an organic EL display device life is defined by a luminance half-life. The luminance unevenness and the screen burn-in reach allowable limits thereof with the luminance difference of several percent, and hence the luminous efficiency reduction of the organic EL element is a cause of a significant reduction in device life. Therefore, there is a demand to compensate for the display luminance reduction caused by the current luminous efficiency reduction of the organic EL element.

SUMMARY OF THE INVENTION

According to the present invention, there is provided a display device, including a plurality of pixels arranged in matrix, each of the plurality of pixels being driven by a drive circuit, in which: the each of the plurality of pixels includes: a light emitting element which emits light in accordance with a current flowing through the light emitting element; and a drive element for controlling a drive current to be supplied to the light emitting element in accordance with a data signal representing a target luminance of the light emitting element; the drive circuit includes a correction unit for correcting the data signal to be supplied to the drive element in accordance with a light emitting element voltage applied at both terminals of the light emitting element; and the correction unit corrects the data signal so that the drive current to be supplied to the light emitting element in accordance with the data signal increases with an increase in an amount of a voltage drop of the light emitting element.

Further, it is preferred that, in the display device according to the present invention, the drive element be a transistor, and the correction unit apply, to the drive element, a voltage, which is one of proportional to and has a positive correlation with the data signal and the light emitting element voltage.

Further, it is preferred that, in the display device according to the present invention, the correction unit include a multiplier circuit having the data signal and the light emitting element voltage as an input.

Further, it is preferred that, in the display device according to the present invention, the multiplier circuit included in the correction unit be formed of a single transistor element which has a source electrode and a gate electrode as an input and a drain electrode as an output.

Further, it is preferred that the display device according to the present invention further include, in the each of the plurality of pixels, in addition to the correction unit provided in the each of the plurality of pixels, a unit for offsetting a control voltage applied to a gate of the drive element by an amount of fluctuation of a drive voltage of the light emitting element.

As described above, according to the present invention, the data signal is corrected in accordance with a change of the drive voltage (turn-on voltage) of the light emitting element, and hence it is possible to compensate for the drive current reduction caused by the data signal due to the deterioration of the light emitting element.

DETAILED DESCRIPTION OF THE PREFERRED EMBODIMENTS

Figure 1:
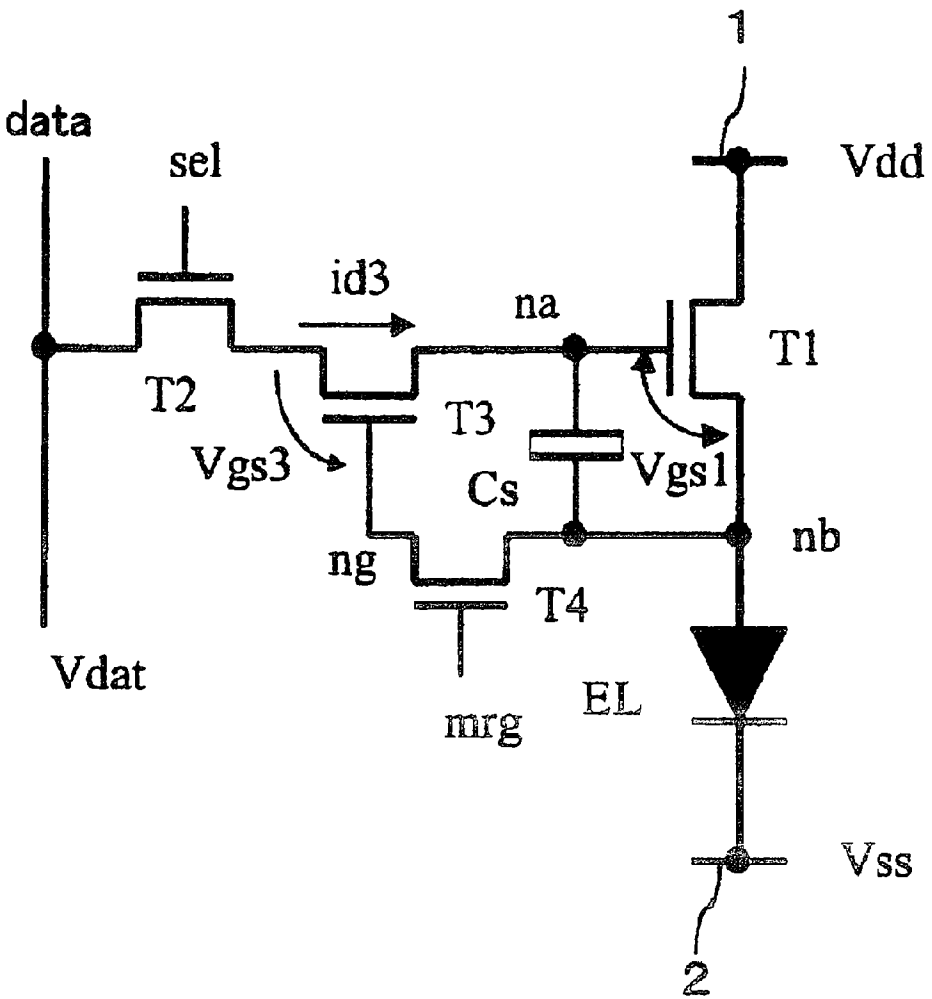
FIG. 1 is a diagram illustrating a configuration of a pixel circuit according to a first embodiment of the present invention.

Hereinafter, embodiments of the present invention are described with reference to the attached drawings.

(Consideration of Current Luminous Efficiency Reduction)

Element characteristics of an organic EL element are deteriorated by its use. Generally, because of this deterioration, a current luminous efficiency of the element is reduced and an element drive voltage rise occurs. The cause of the current luminous efficiency reduction has not been completely figured out, but it is understood that generation of a non-radiative recombination center, which is caused by change in properties of the light emitting material, causes the luminous efficiency reduction and the drive voltage rise (M. E. Kondakova et al., SID 09 DIGEST, p 1677). As described in M. E. Kondakova et al., SID 09 DIGEST, p 1677, there is a strong correlation between the drive voltage rise and the current luminous efficiency reduction of the organic EL element. Therefore, from the amount of the drive voltage rise, it is possible to predict the deterioration amount of the light emitting characteristics of the organic EL element. That is, the luminous efficiency reduction and the drive voltage (capacitance transition voltage) rise are substantially linear, and further, hardly depend on temperature. Here, the capacitance transition voltage is a voltage at which carriers are excited in an organic layer and a change in capacitance of the organic EL element is observed. As described in M. E. Kondakova et al., SID 09 DIGEST, p 1677, the capacitance transition voltage rise can be explained by the generation of the non-radiative recombination center with a deep energy level.

Therefore, the recombination center acts as a trap, and I-V characteristics of the organic EL element are shifted simply to a positive direction of the voltage. With usage of this, the deterioration of the organic EL element may be compensated for with a method which is relatively simple. The capacitance transition voltage is a voltage at which the carriers start to increase in the element in accordance with voltage application, and hence, owing to the I-V characteristics, the capacitance transition voltage corresponds to a turn-on voltage of the element in broad perspective. The capacitance transition voltage rise is observed as a turn-on voltage rise of the element, and the entire drive voltage of the element increases in accordance with the turn-on voltage rise.

(Compensation for Current Luminous Efficiency Reduction)

Light emission intensity L from the organic EL element is proportional to a drive current $I_d$ of the element. When the current luminous efficiency is represented by $\eta$, the following expression is satisfied.

$$L=\eta \cdot I_d \tag{1}$$

When a drive voltage rise of the organic EL element is represented by $\Delta_{Voled}$, and it is assumed that $\Delta_{Voled}$ is proportional to a current luminous efficiency reduction $\Delta\eta$ of the element, the following expression is satisfied.

$$\Delta\eta=\kappa\Delta_{Voled} \tag{2}$$

where $\kappa$ represents a constant that does not depend on temperature.

Meanwhile, the drive current $I_d$ supplied from a TFT element may be expressed as follows.

$$I_d=(\beta/2)(V_g-V_{th})^2 \tag{3}$$

where $\beta$ represents a transconductance, and $V_g$ and $V_{th}$ represent a gate-source voltage and a threshold voltage, respectively, of the drive TFT.

When a voltage proportional to a display data signal voltage $V_{dat}$ and a drive voltage $V_0$ of the organic EL element is applied as the gate-source voltage $V_g$ of the drive TFT, the following expression is satisfied.

$$V_g=V_{dat}(aV_0+b) \tag{4}$$

Here, the drive voltage $V_0$ corresponds to the turn-on voltage of the organic EL element as described above. Hereinafter, the drive voltage $V_0$ is described as the turn-on voltage $V_0$.

This may be realized by, in the circuit, adding $V_{dat}$ and the multiplier output of $V_{dat}$ and $V_0$. Note that, "a" and "b" are constants determined based on designs of a multiplier circuit and an adder circuit.

Here, when it is assumed that the drive voltage of the organic EL element is changed by $\Delta\nu$ by the deterioration of the element, $V_g$ may be expressed as follows.

$$V_g=V_{dat}\{aV^0{}_0(1+\Delta\nu)+b\} \tag{5}$$

where $V^0{}_0$ represents a drive voltage value of the organic EL element before the deterioration thereof.

$\Delta\nu$ is considered to be sufficiently smaller than 1, and hence, from Expressions (1), (3), and (5), the light emission intensity L may be expressed as follows.

$$L\approx(\beta/2)V_{dat}{}^2\cdot\xi^2(1-\Delta\eta)(1+\lambda\Delta V_0)$$

Note that, the following expressions are satisfied.

$$\xi=aV^0{}_0+kb$$

$$\lambda=(2aV^0{}_0)/(aV^0{}_0+b)$$

Here, when $V_0$ is determined so as to satisfy $\kappa=\lambda$, Expression (5) satisfies $$L\approx(\beta/2)V_{dat}{}^2\cdot\xi^2,$$

and hence the light emission intensity L from the organic EL element becomes substantially constant regardless of the luminous efficiency reduction of the element.

Therefore, it is found that, by applying the voltage proportional to the display data signal voltage $V_{dat}$ and the turn-on voltage $V_0$ of the organic EL element, which is represented in Expression (4), as the gate-source voltage $V_g$ of the drive TFT, and by appropriately setting the constant "b", it is possible to prevent the light emission intensity L from receiving influence from the current luminous efficiency η.

First Embodiment

FIG. 1 is a circuit diagram for one pixel according to a first embodiment of the present invention. The pixel includes a drive transistor T1, a write transistor T2, a transistor T3 which serves as a multiplier, a transistor T4 for controlling a multiplier input of the transistor T3, a storage capacitor Cs, and an organic EL element EL.

The drive transistor T1 has a drain connected to a power source 1 for supplying a high voltage Vdd, and a source connected to an anode of the organic EL element EL. A cathode of the organic EL element EL is connected to a power source 2 for supplying a low voltage Vss. With this, a drive current flowing through the drive transistor T1 is supplied to the organic EL element EL. The storage capacitor Cs is connected between a gate and the source of the drive transistor T1.

The transistor T2 has a source connected to a data line dat, and a drain connected to a source of the transistor T3. Further, the transistor T3 has a drain connected to the gate of the drive transistor T1 and a gate connected to the anode of the organic EL element EL via the transistor T4.

A gate of the transistor T2 is connected to a selection control line sel, and a gate of the transistor T4 is connected to a merge control line mrg. The transistor T2 and the transistor T4 are controlled by voltages applied to those lines. A display data signal voltage $V_{dat}$ and a constant voltage $V_{blk}$ are alternately loaded to the data line dat. Here, the voltage $V_{blk}$ is a constant voltage which turns OFF the drive transistor T1.

Figure 2:
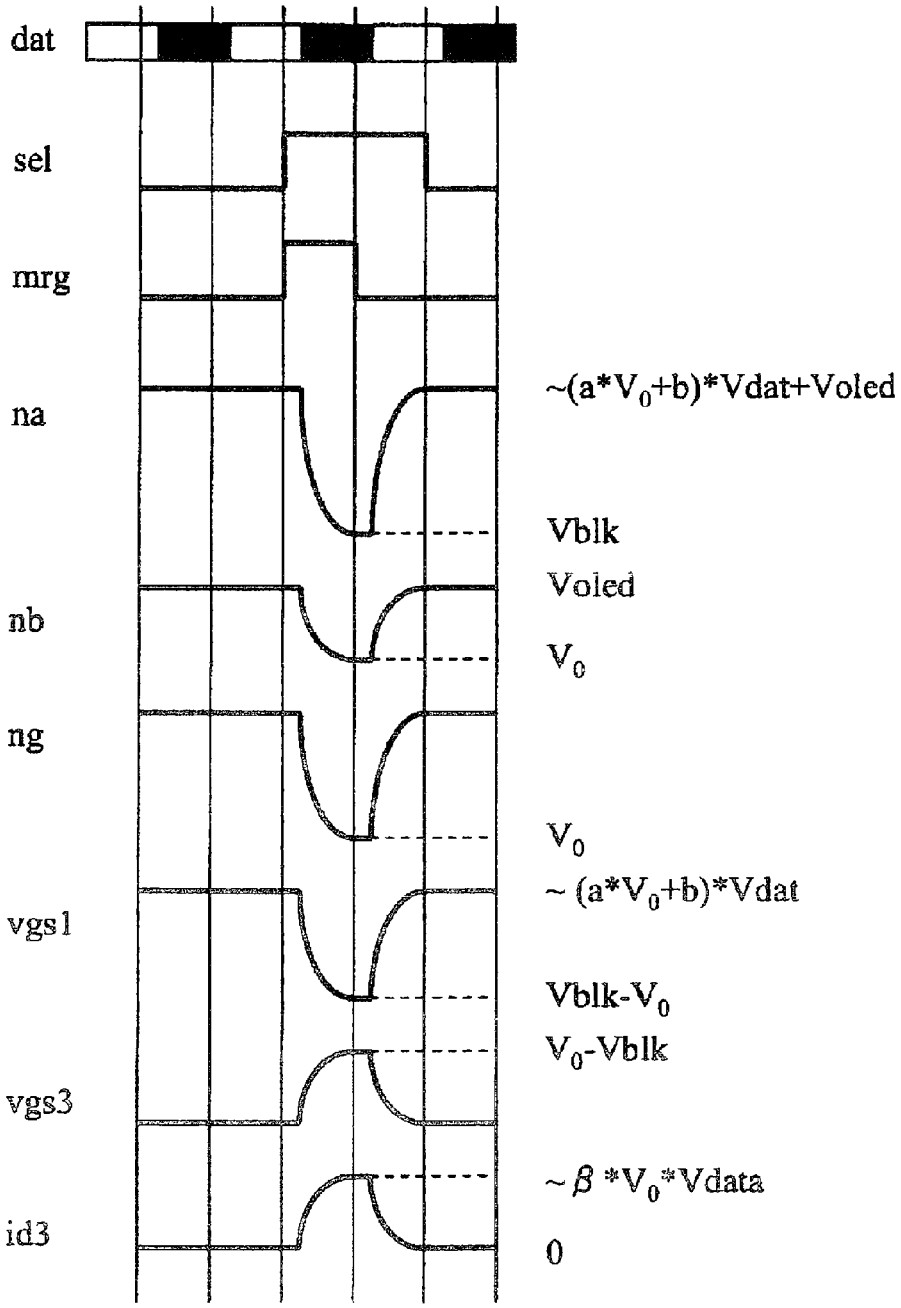
FIG. 2 is a drive waveform diagram of the first embodiment.

FIG. 2 illustrates signal waveforms at respective portions in the circuit of the first embodiment. With reference to FIG. 2, a method of driving the circuit is described. In FIG. 2, "dat" indicates a state of a signal of the data line dat, and the display data signal voltage $V_{dat}$, which is indicated by outlined periods, and a predetermined low voltage $V_{blk}$, which is indicated by black colored periods, are alternately applied to the data line dat. Hereinafter, description is made of an operation from a timing at which the selection control line sel is caused to rise up in FIG. 2. Note that, before the rising up of the selection control line sel, in the pixel, the organic EL element EL is driven by a current flowing through the drive transistor T1 in accordance with a voltage $V_{gs1}$ stored in the storage capacitor Cs.

Under a state in which the voltage of the data line dat is set to the voltage $V_{dat}$, which is a predetermined high voltage, the selection control line sel is set to have a H level voltage and the merge control line mrg is also set to have a H level voltage. With this, the transistors T2 and T4 are turned ON. At this time, the gate of the transistor T3 is connected to the anode of the organic EL element EL. The anode of the organic EL element EL is set to have a voltage higher by $V_{oled}$, which corresponds to the voltage drop in the organic EL element EL, with respect to Vss (for example, 0 V) of a cathode potential. Therefore, the transistor T3 is also in an ON state.

Next, the voltage of the data line is set to $V_{blk}$, which is a predetermined low voltage, and $V_{blk}$ is supplied from the data line dat to the gate (node na) of the drive transistor T1. $V_{blk}$ is a low voltage, and hence the drive transistor T1 is turned OFF, and the potential of the anode (node nb) of the organic EL element EL is dropped to approach asymptotically to the turn-on voltage $V_0$ of the organic EL element EL. With this, $V_0$ is held at the gate of the transistor T3 via the transistor T4. At this stage, $V_0-V_{blk}$ is stored in the storage capacitor Cs. Further, $V_0$ is a voltage higher than $V_{blk}$, and hence the transistor T3 is held in an ON state.

Next, the merge control line mrg is set to have a L level voltage, and the transistor T4 is turned OFF. Then, the data line dat is set to have the signal voltage $V_{dat}$. At this time, the turn-on voltage $V_0$ of the organic EL element EL is applied to the gate of the transistor T3, and the signal voltage $V_{dat}$ is applied to the drain of the transistor T3.

When the transistor T3 is operated in a linear region, a current $I_3$ flowing through the transistor T3 is substantially proportional to $V_{gs3}$ (which is proportional to $V_0$) and $V_{ds3}$ of the transistor T3. That is, a current is caused to flow through the transistor T3 in accordance with a value obtained by multiplying $V_0$ and $V_{dat}$. With this current, the gate voltage rise of the drive transistor T1 occurs, and a current is caused to flow through the drive transistor T1, to thereby cause the organic EL element EL to emit light.

The current amount at this time is determined in accordance with the gate-source voltage $V_{gs1}$ of the drive transistor T1. As described above, the gate voltage of the drive transistor T1 is proportional to $V_0$ at that time.

That is, the gate-source voltage $V_{gs}$ is set as follows.

$$V_{gs}=V_{dat}*(aV_0+b)$$

Note that, in FIG. 2, the data voltage $V_{dat}$ is assumed to be a constant voltage. Therefore, before and after the writing of the data voltage $V_{dat}$ is performed as described above, the data voltage $V_{dat}$ is always recovered to the same voltage. In actual, the data voltage $V_{dat}$ may have an arbitrary value, but description thereof is similar to that of this embodiment, and hence the description is omitted.

As described above, according to the circuit of this embodiment, the gate-source voltage of the drive transistor T1 (=charged voltage of the storage capacitor Cs) when the transistor T2 is turned OFF is a voltage corresponding to a value obtained by multiplying $V_0$, which is the gate voltage of the transistor T3, and $V_{dat}$, which is the drain voltage of the transistor T3. Note that, the transistor T4 is in the OFF state, and hence the voltage of the gate ng of the transistor T3 increases as the source voltage changes from $V_{blk}$ to $V_{dat}$. Thus, the ON state of the transistor T3 is maintained.

That is, a voltage which is proportional to $V_0$ and $V_{dat}$ (which corresponds to the voltage obtained by multiplying $V_0$ and $V_{dat}$) is applied as $V_{gs1}$ of the drive transistor T1. Therefore, when $V_0$ increases with the deterioration of the organic EL element EL, a current supplied to the organic EL element EL with respect to the same signal voltage input $V_{dat}$ increases, to thereby compensate for the deterioration amount of the luminous efficiency of the organic EL element EL.

In this embodiment, the pixel circuit compensates for only the luminous efficiency reduction of the organic EL element and the drive voltage rise. That is, it is preferred that the characteristic fluctuation of the drive TFT and the TFT deterioration by its use occur to a negligible extent. For example, this embodiment is preferred to be applied to a polycrystalline silicon TFT substrate, which has sufficient in-plane uniformity due to process optimization, or a microcrystalline silicon TFT substrate and an oxide TFT substrate, which have excellent in-plane uniformity and small drive TFT deterioration.

Second Embodiment

Figure 3:
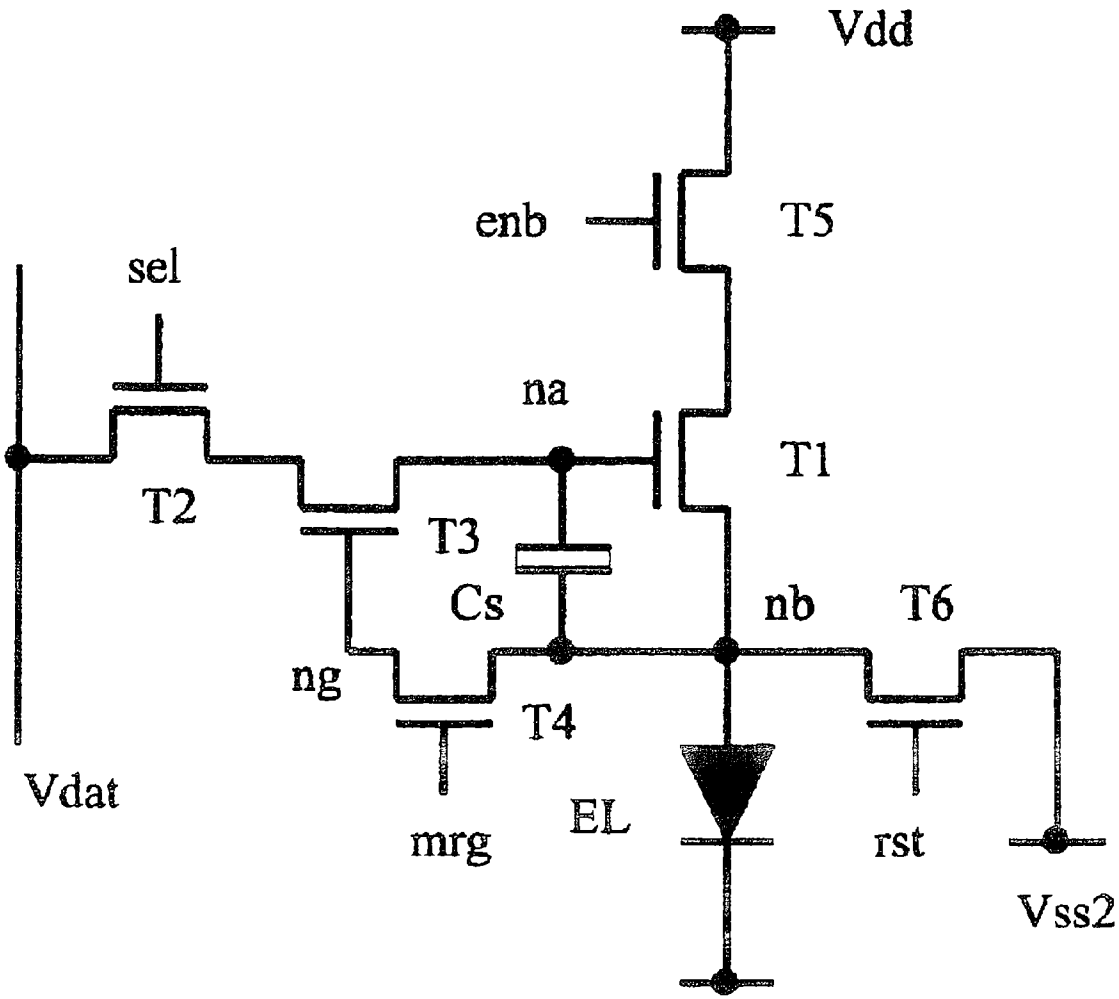
FIG. 3 is a diagram illustrating a configuration of a pixel circuit according to a second embodiment of the present invention.

FIG. 3 is a circuit diagram according to a second embodiment of the present invention. The second embodiment exemplifies, in consideration of general application thereof, a circuit in which a function of compensating for a threshold voltage of the drive TFT is added besides compensating for luminous efficiency deterioration of the organic EL element. The circuit according to the second embodiment includes, in addition to the components of the circuit according to the first embodiment, a light emission control transistor T5 and a reset transistor T6. Therefore, the circuit of the second embodiment includes six transistors and one capacitor.

The transistor T5 is inserted in series between the power source 1 and the drive transistor T1. The transistor T5 turns ON/OFF the drive current and controls the light emission period. In order to reset the anode voltage of the organic EL element EL, the transistor T6 is disposed between the anode of the organic EL element EL and a power source 3 for supplying a voltage Vss2.

Figure 4:
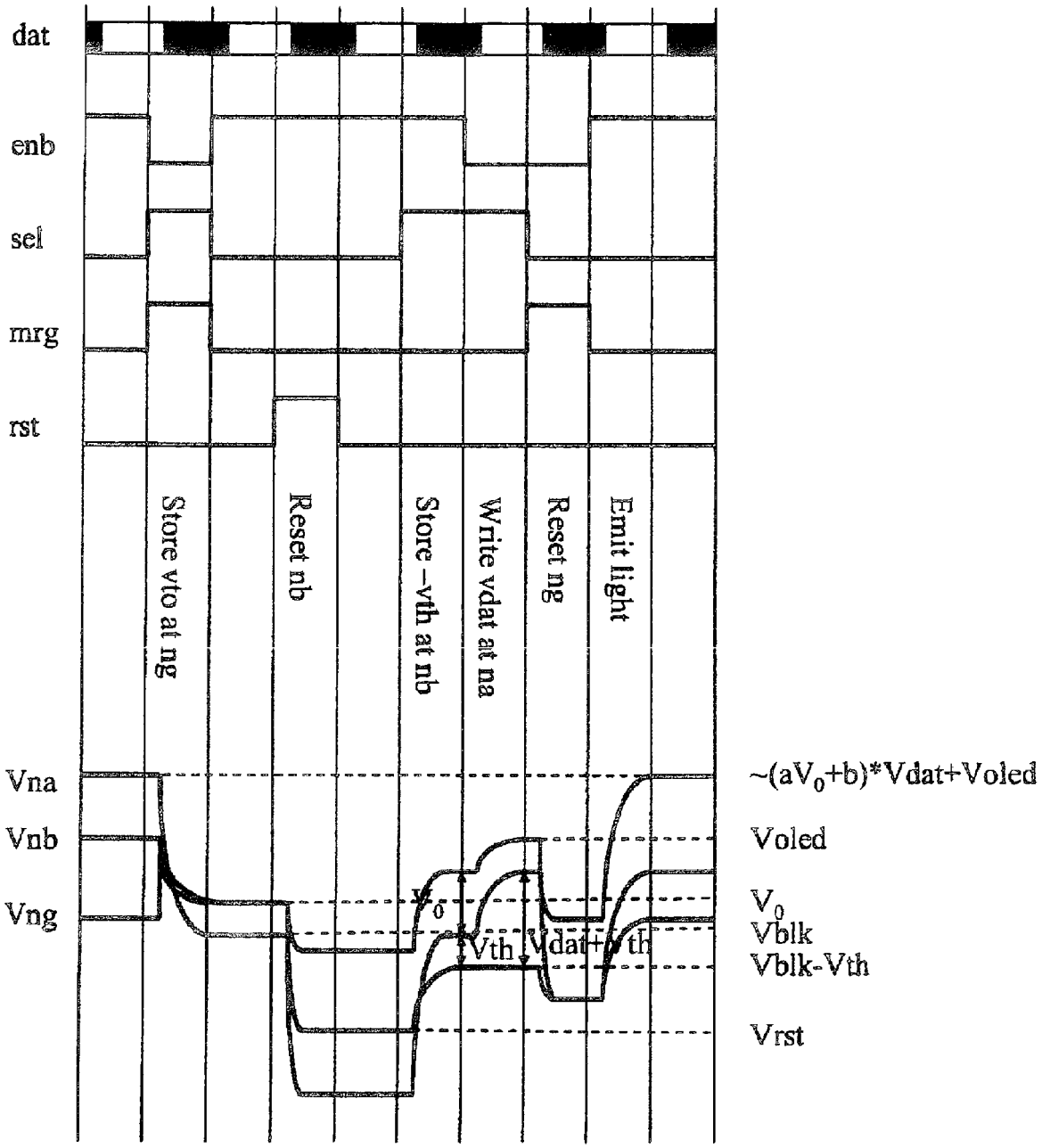
FIG. 4 is a drive waveform diagram of the second embodiment.

FIG. 4 illustrates drive voltage waveforms of the circuit according to the second embodiment. First, the merge control line mrg is set to have a H level voltage so as to turn ON the transistor T4. At this time, the transistors T5 and T6 are turned OFF, and the transistor T2 is turned ON, and then a constant voltage $V_{blk}$ is written from the data line. $V_{blk}$ is a low voltage, and hence the potential of the anode (nb) of the organic EL element EL is set to be near the turn-on voltage $V_0$ of the organic EL element EL. At this time, the transistor T4 is in an ON state, and hence $V_0$ is held at the gate of the transistor T3.

Then, the transistor T4 is turned OFF and the transistor T6 is turned ON so that the anode of the organic EL element EL is connected to the power source 3, which has the predetermined low voltage Vss2, to thereby reset the anode of the organic EL element EL to the voltage Vss2. With this, the voltage of the organic EL element EL becomes equal to or lower than $V_0$. Then, the transistor T6 is turned OFF to write the constant voltage $V_{blk}$ to the gate of the drive transistor T1. Then, the transistor T5 is turned ON, to thereby cause a current to flow through the organic EL element EL. As a result, the anode potential of the organic EL element EL increases, and at a timing when the anode potential reaches $V_{blk}$-$V_{th}$ (at a timing when the gate-source voltage of the drive transistor T1 matches the threshold voltage $V_{th}$ thereof), the drive transistor T1 is turned OFF.

Next, a desired signal voltage $V_{dat}$ is written from the data line dat. At this time, a turn-on voltage $V_0$ of the organic EL element EL is applied to the gate of the transistor T3, and the signal voltage $V_{dat}$ is applied to the drain of the transistor T3.

When the transistor T3 is operated in a linear region, the current $I_3$ flowing through the transistor T3 is substantially proportional to $V_{gs}$ ($V_{gs2}$) and $V_{ds}$ of the transistor T3. When the transistor T2 is turned OFF after a predetermined time period, at one terminal of the storage capacitor Cs on the gate side of the drive transistor T1, a potential obtained by adding $V_{blk}$ to the voltage proportional to the gate voltage $V_{gs2}$ and the drain voltage $V_{dat}$ of the transistor T3 is held.

Meanwhile, the other terminal of the storage capacitor Cs is connected to the source of the drive transistor T1 and the anode of the organic EL element EL, and $V_{gblk}$–$V_{th}$ is held. That is, a voltage obtained by adding $V_{th}$ to the voltage ($V_{dat}$*($aV_0$+b)+$V_{blk}$) proportional to $V_0$ and $V_{dat}$ is applied as $V_{gs}$ ($V_{gs1}$) of the drive transistor T1.

As described above, in the second embodiment, the gate-source voltage $V_{gs1}$ of the drive transistor T1 is offset by $V_{th}$, and hence the pixel current does not depend on the change of the threshold voltage $V_{th}$ of the drive transistor T1. Further, the gate-source voltage $V_{gs1}$ of the drive transistor T1 is proportional to $V_0$ and $V_{dat}$, and hence, when $V_0$ increases with the deterioration of the organic EL element EL, the pixel current increases, to thereby compensate for the luminous efficiency reduction of the organic EL element EL, which has a linear relation with the $V_0$ rise.

Hereinafter, effects are described with reference to the pixel circuit according to the second embodiment as an example. The deterioration characteristics of the organic EL element are cited from the data of M. E. Kondakova et al., SID 09 DIGEST, p 1677 as an example, and the pixel current is obtained by calculation by a circuit simulator.

Figure 5A:
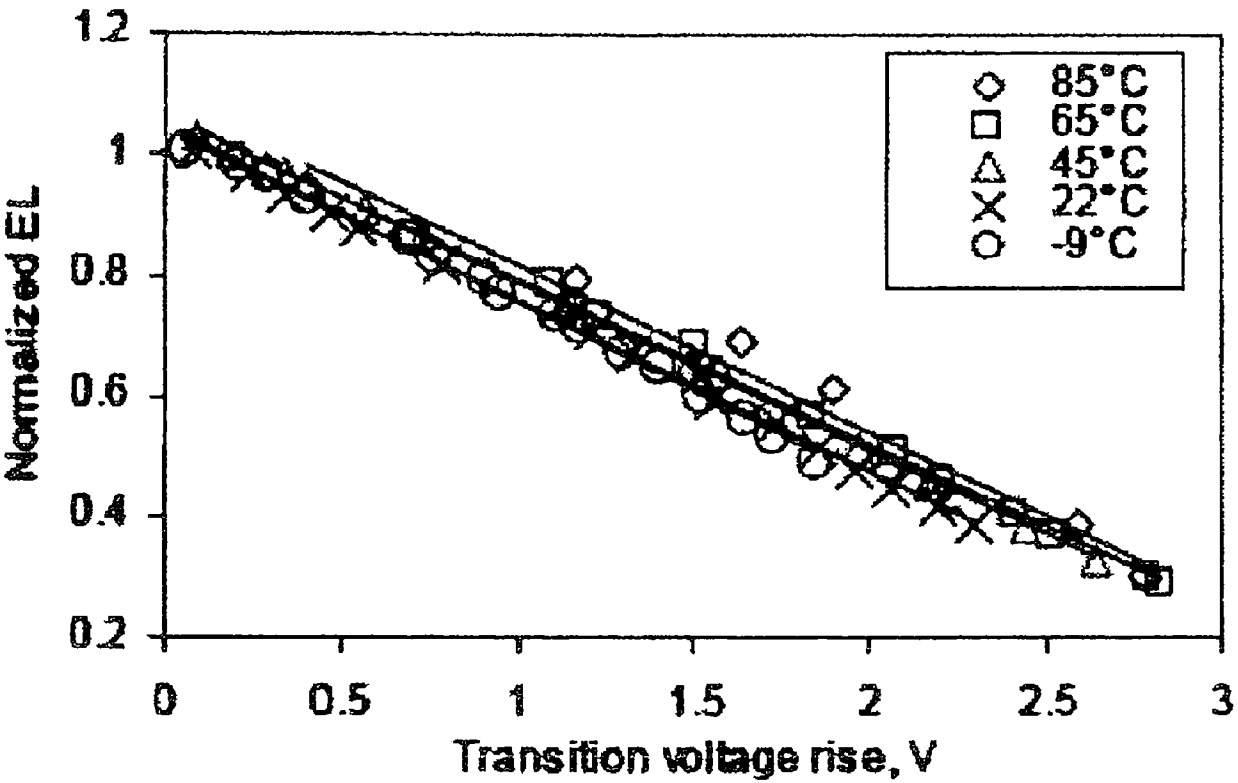
FIG. 5A is a graph illustrating a relationship between a light emission luminance at a low current of an organic EL element and a voltage of the element.
Figure 5B:
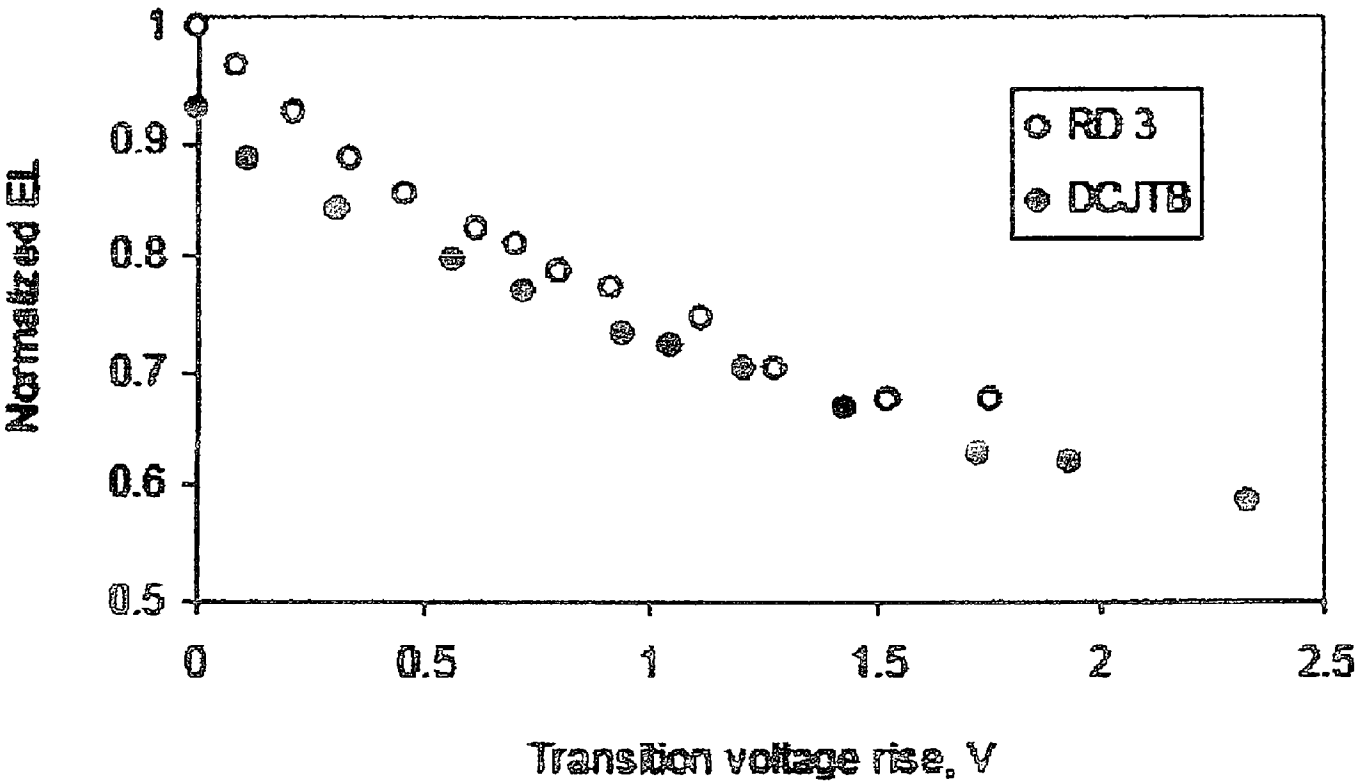
FIG. 5B is a graph illustrating a relationship between a light emission luminance at a low current of an organic EL element and a voltage of the element.

FIGS. 5A and 5B are graphs illustrating a relationship between a luminance of the organic EL element, which is cited from the data of M. E. Kondakova et al., SID 09 DIGEST, p 1677, and the capacitance transition voltage. After the organic EL element is driven under various temperatures to be deteriorated, the organic EL element is driven at a constant current under room temperature. The relative value of the luminance and the capacitance transition voltage rise at this time are measured, and the results are plotted. A relative change of the luminance when the organic EL element is driven at a constant current is the same as a relative change of the current luminous efficiency at that current density.

Further, as described above, the change of the capacitance transition voltage of the element is the same as the change of the element drive voltage (voltage corresponding to the turn-on potential of the element). FIG. 5A illustrates measurement results in a case where there is used an organic EL element in which NPB, C545T-doped Alq, and Alq are laminated and the element is driven under various temperatures to be deteriorated. FIG. 5B illustrates measurement results in a case where a red dopant RD3 or DCJTB is doped in a light emission layer, and the element is deteriorated under 65° C.

Figure 6:
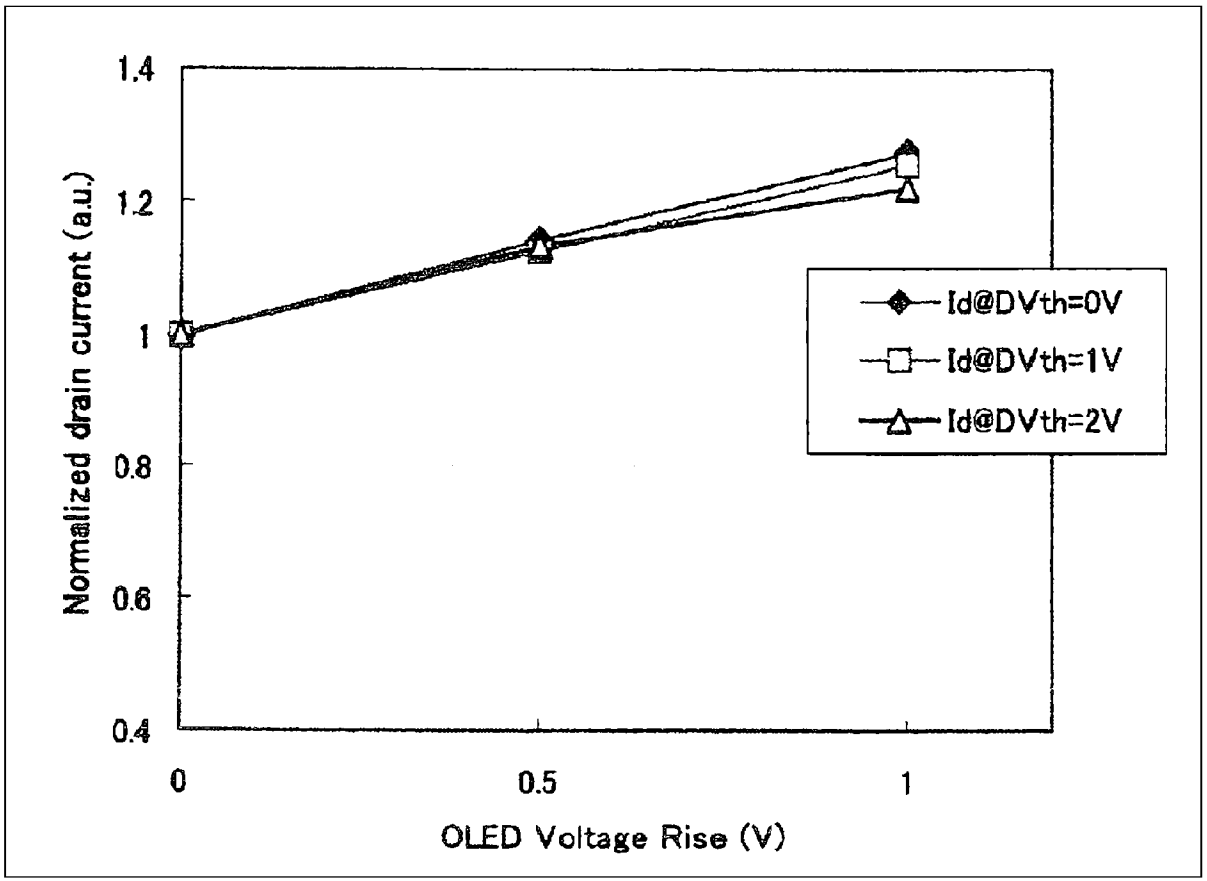
FIG. 6 is a graph illustrating an example of pixel current simulation of the circuit of the second embodiment.

FIG. 6 illustrates simulation results of the pixel current when, in the circuit according to the second embodiment, the threshold voltage $V_{th}$ of the drive transistor T1 is changed in the range of from 0 V to 2 V, and the turn-on voltage $V_0$ of the organic EL element is changed in the range of from 0 V to 1 V. It is found that the pixel current hardly depends on the change of $V_{th}$ of the drive transistor T1, whereas the pixel current substantially linearly increases in accordance with the drive voltage (turn-on voltage) rise of the organic EL element.

Figure 7A:
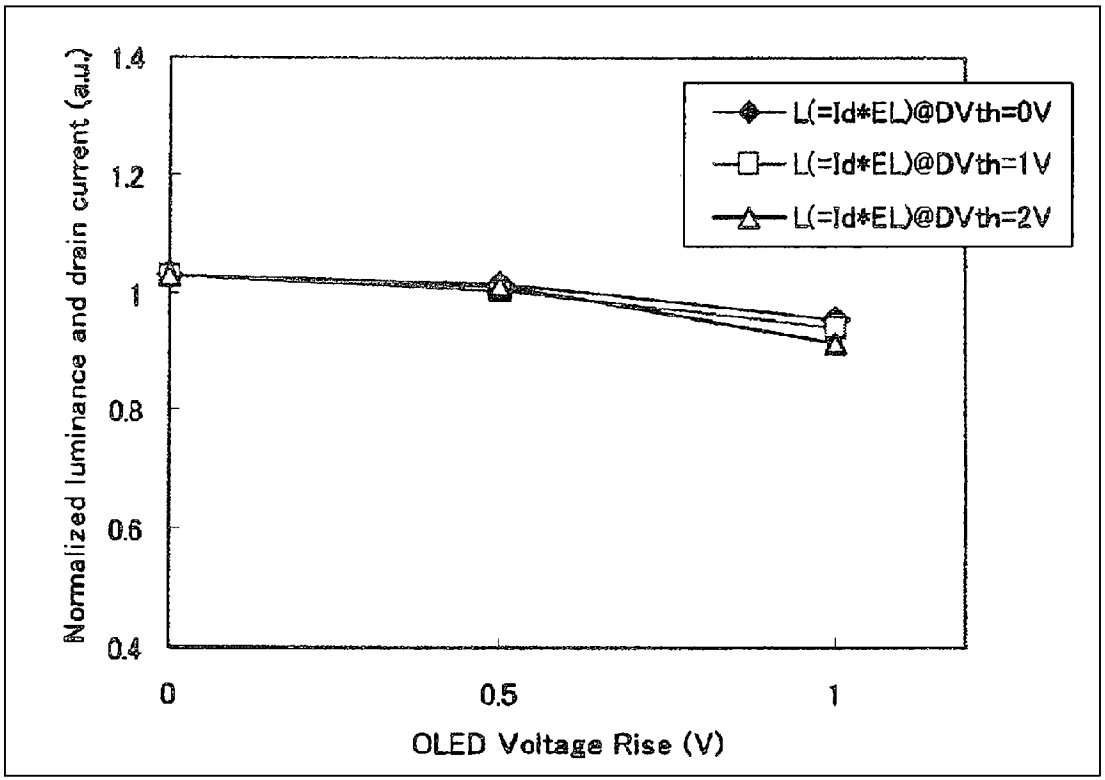
FIG. 7A is a graph illustrating an example of pixel luminance compensation calculation performed by the circuit of the second embodiment.
Figure 7B:
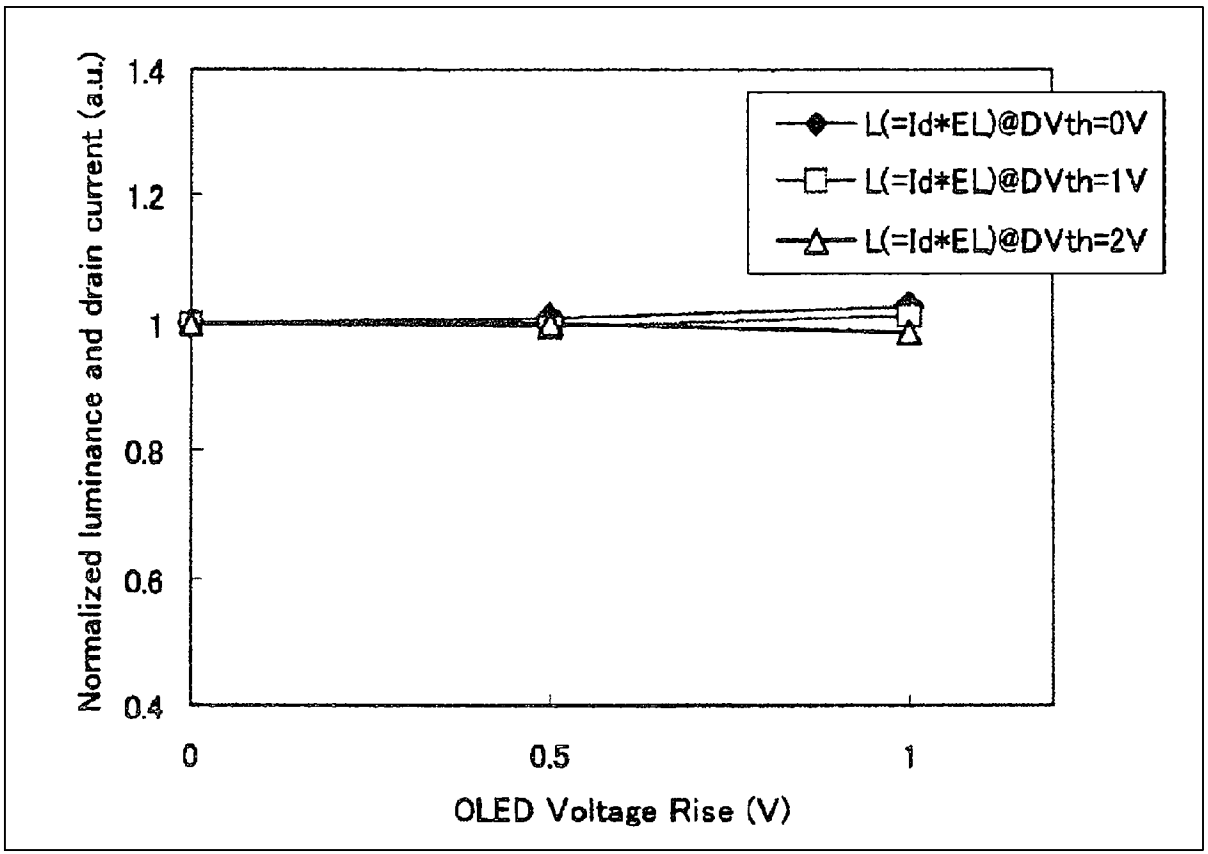
FIG. 7B is a graph illustrating an example of pixel luminance compensation calculation performed by the circuit of the second embodiment.

Assuming that the organic EL element is each of the elements represented in FIGS. 5A and 5B, the change of the pixel luminance with respect to the deterioration of the organic EL element is calculated with the use of the results of FIG. 6. FIGS. 7A and 7B illustrate the relative change of the pixel luminance when the turn-on voltage of the organic EL element is changed by 0 V, 0.5 V, and 1 V, with $V_{th}$ of the drive transistor T1 as a parameter.

In FIG. 7A, the deterioration characteristics of the organic EL element are assumed as those of the element represented in FIG. 5A. From FIG. 7A, it is found that, when the turn-on voltage of the organic EL element is changed in a range of from 0 V to 0.5 V, there is only a small difference in the relative value of the pixel luminance with respect to the change of $V_{th}$, and the change of $V_{th}$ is sufficiently compensated for in the range of from 0 V to 2 V.

Meanwhile, it is found that the relative value of the pixel luminance with respect to the turn-on voltage of the organic EL element hardly changes in the range of from 0 V to 0.5V, and although there is a slight reduction when the turn-on voltage is 1 V, the reduction is noticeably compensated for compared with the case of about 75% (FIG. 5A) of the constant current light emission luminance relative value when the turn-on voltage change of the original organic EL element is 1 V.

In FIG. 7B, in which calculation is performed with respect to the organic EL element of FIG. 5B, further satisfactory effects are obtained, and although the organic EL element is deteriorated by about 25% (even when the turn-on voltage change of the organic EL element is 1 V in FIG. 5B), the relative value of the pixel luminance is substantially maintained to its initial value.

From the results described above, it is found that, by appropriately designing the compensation circuit of the second embodiment, it is possible to compensate for not only the $V_{th}$ shift of the drive transistor (TFT) but also the drive voltage (turn-on voltage) change of the organic EL element and the luminous efficiency deterioration.

What is claimed is:

1. A display device, comprising a plurality of pixels arranged in a matrix, each of the plurality of pixels comprising:

a light emitting element, comprising an anode and a cathode, which emits light in accordance with a drive current flowing through the light emitting element from the anode to the cathode;

a drive element for controlling the drive current to be supplied to the light emitting element in accordance with a data signal representing a target luminance of the light emitting element; and a correction unit for correcting the data signal to be supplied to the drive element in accordance with a voltage at the anode of the light emitting element, wherein the correction unit comprises a multiplier circuit having the data signal and the voltage at the anode of the light emitting element as inputs;

wherein the correction unit corrects the data signal so that the drive current to be supplied to the light emitting element in accordance with the data signal increases with an increase in the voltage at the anode of the light emitting element.

2. A display device according to claim 1, wherein:

the drive element comprises a transistor; and the correction unit applies to the drive element a voltage which is proportional to and has a positive correlation with the data signal and the voltage at the anode of the light emitting element.

3. A display device according to claim 1, wherein the multiplier circuit included in the correction unit is formed of a single transistor element which has a source electrode and a gate electrode as an input and a drain electrode as an output.

4. A display device according to claim 1, further comprising a unit for offsetting a control voltage applied to a gate of the drive element by an amount of fluctuation of a drive voltage of the light emitting element.

5. A display device, comprising a plurality of pixels arranged in a matrix, each of the plurality of pixels comprising:

a light emitting element, comprising an anode and a cathode, which emits light in accordance with a drive current flowing through the light emitting element from the anode to the cathode;

a drive element for controlling the drive current to be supplied to the light emitting element in accordance with a data signal representing a target luminance of the light emitting element; and a correction unit for correcting the data signal to be supplied to the drive element in accordance with a voltage at the cathode of the light emitting element, wherein the correction unit comprises a multiplier circuit having the data signal and the voltage at the cathode of the light emitting element as inputs;

wherein the correction unit corrects the data signal so that the drive current to be supplied to the light emitting element in accordance with the data signal increases with an increase in the voltage at the cathode of the light emitting element.

6. A display device according to claim 5, wherein:

the drive element comprises a transistor; and the correction unit applies to the drive element a voltage which is proportional to and has a positive correlation with the data signal and the voltage at the cathode of the light emitting element.

7. A display device according to claim 5, wherein the multiplier circuit included in the correction unit is formed of a single transistor element which has a source electrode and a gate electrode as an input and a drain electrode as an output.

8. A display device according to 5, further comprising a unit for offsetting a control voltage applied to a gate of the drive element by an amount of fluctuation of a drive voltage of the light emitting element.

* * * * *